US006846100B2

(12) United States Patent
Imazeki et al.

(10) Patent No.: US 6,846,100 B2
(45) Date of Patent: Jan. 25, 2005

(54) LIGHTING FIXTURE FOR VEHICLES

(76) Inventors: Norifumi Imazeki, c/o Stanley Electric Co., Ltd., 2-9-13 Nakameguro, Meguro-ku, Tokyo 153-8636 (JP); Takashi Nakanishi, c/o Stanley Electric Co., Ltd., 2-9-13 Nakameguro, Meguro-ku, Tokyo 153-8636 (JP); Takeaki Okamura, c/o Stanley Electric Co., Ltd., 2-9-13 Nakameguro, Meguro-ku, Tokyo 153-8636 (JP); Nobuyuki Suzuki, c/o Stanley Electric Co., Ltd., 2-9-13 Nakameguro, Meguro-ku, Tokyo 153-8636 (JP); Hirokuni Osugi, c/o Stanley Electric Co., Ltd., 2-9-13 Nakameguro, Meguro-ku, Tokyo 153-8636 (JP); Kentaro Hayashi, c/o Stanley Electric Co., Ltd., 2-9-13 Nakameguro, Meguro-ku, Tokyo 153-8636 (JP)

( * ) Notice: Subject to any disclaimer, the term of this patent is extended or adjusted under 35 U.S.C. 154(b) by 0 days.

(21) Appl. No.: 10/260,549

(22) Filed: Oct. 1, 2002

(65) Prior Publication Data

US 2003/0169598 A1 Sep. 11, 2003

(30) Foreign Application Priority Data

Feb. 25, 2002 (JP) ..... 2002-047892
May 24, 2002 (JP) ..... 2002-151109

(51) Int. Cl.[7] ..... F21V 7/09

(52) U.S. Cl. ..... 362/517; 362/298; 362/346; 362/545

(58) Field of Search ..... 362/517, 545, 362/297, 301, 341, 347, 298, 346, 555, 800, 542, 242, 260, 541

(56) References Cited

U.S. PATENT DOCUMENTS 6,332,701 B1 * 12/2001 Yamada et al. ..... 362/517
6,347,880 B1 * 2/2002 Furst et al. ..... 362/494
6,447,155 B2 * 9/2002 Kondo et al. ..... 362/545
6,457,850 B2 * 10/2002 Oyama et al. ..... 362/517
6,637,923 B2 * 10/2003 Amano ..... 362/545

* cited by examiner

*Primary Examiner*—Alan Cariaso
*Assistant Examiner*—Guiyoung Lee
(74) *Attorney, Agent, or Firm*—Nath & Associates PLLC; Harold L. Novick

(57) ABSTRACT

A lighting fixture is configured such that it comprises at least one light source, a first reflecting surface which reflects light from the light source or sources to change it into parallel light, one intermediate reflecting surface which reflects parallel light from the first reflecting surface toward the second reflecting surface, a second reflecting surface which reflects light reflected by the intermediate reflecting surface forward and one lens provided forwardly of the second reflecting surface and such that the light source is provided outside the lens in relation to the direction of the optical axis.

3 Claims, 17 Drawing Sheets

(A)

(B)

LIGHTING FIXTURE FOR VEHICLES

BACKGROUND OF THE INVENTION

1. Field of the Invention

The present invention relates to a lighting fixture for vehicles for signaling purposes, such as vehicle-mounted tail lamp, brake lamp, turn signal and high-mount stop lamp, used to signal other vehicles and pedestrians of one's intended action, or to a lighting fixture for use as a variety of illumination lamps.

2. Description of the Relates Arts

Conventionally, when a vertical or horizontal lighting fixture for vehicles is configured using light-emitting components such as LEDs, a number of LEDs are arranged in the direction of the length, and light emitted sideward by the LEDs is reflected by a reflecting material such that it is radiated forward. Such a configuration, when LEDs emit light, allows part of light from the LEDs to be directly reflected and some other part of light to be reflected by a reflecting material such that light is radiated forward, as a result of which the entire, vertical or horizontal light-emitting surface can appear illuminated.

An example of such a configuration is shown in FIG. 19 and represented here by a lighting fixture for vehicles 100 which uses an incandescent lamp as light source 91 and is provided with a parabolic reflecting surface 92 such as paraboloid of revolution, whose focus is the light source 91, to generate parallel light headed in the direction of illumination of this lighting fixture for vehicles 100.

Moreover, an outer lens 93 is provided to cover the front of the reflecting surface 92 so that light is diffused properly by lens cuts 93*a*, provided in the outer lens 93, for example, in the form of a fisheye lens, thus offering light distribution characteristic of the lighting fixture for vehicles 100.

Note that there are some lighting fixtures in which projections and depressions comparable to the lens cuts 93*a* are provided on the reflecting surface 92 while no lens cuts are provided on the outer lens 93*a*, so that light passes with no diffusion.

The lighting fixtures are disclosed in Japan Publication of Patent Applications' 1998-255512, and 1999-96808 and 2000-123610 of the same Publication and in U.S. Pat. No. 6280480.

With lighting fixtures of such a configuration, however, the intensity of light emitted forward directly by LEDs is high, and the directivity of light reflected by a reflecting material is low.

This leads to decreased utilization efficiency of light emitted by the LEDs, and consequently more LEDs are needed to secure an acceptable amount of light, thus resulting in high cost, causing more heat to be produced by LEDs and rendering the light intensity maintenance rate vulnerable to a decline.

Moreover, it looks as through LEDs shone in a dotted manner when they are viewed from the front, and since light reflected by a reflecting material is diffused, light from the reflecting surface of the reflecting material looks dark. As a result, LEDs present an obvious unevenness of light when viewed from the front.

Therefore, since LEDs look highly bright and dotted, they give an impression of being spotty, and since the reflecting surface of the reflecting material does not shine beautifully, the lighting fixture is not highly aesthetically pleasant as a whole.

To render light from LEDs uniform, it is possible, for example, to provide a lens having cuts such as fisheye Fresnel cuts forwardly of the LEDs, however, such a cuts-equipped lens can reduce design freedom of the lighting fixture as a whole.

Moreover, with the lighting fixture for vehicles 100, firstly since the parabolic reflecting surface 92 requiring an appropriate depth is employed to radiate parallel light over a wide area, the lighting fixture for vehicles 100 becomes very deep as a whole, for example, causing the fixture to protrude into the trunk room and reducing the vehicle's carrying capacity.

Secondly, when the outer lens is viewed with the fixture lit, the intensity of portions such as the incandescent lamp's filament is high, as a result of which direct light D from the light source 91 looks exceptionally bright, causing such portions to be out of proportion to other portions whose brightness is determined by reflected light R from the reflecting surface 92 and thus uglifying the fixture during illumination.

SUMMARY OF THE INVENTION

In view of these considerations, the object of the present invention is to provide a lighting fixture designed to ensure increased light beam utilization efficiency and reduce unevenness of light on the light-emitting surface for improved aesthetical pleasantness.

In order to achieve the above object, according to a first aspect of the present invention there is provided a lighting fixture for vehicles comprising at least one light source; a first reflecting surface; a second reflecting surface; the first reflecting surface reflecting light from the at least one light source toward the second reflecting surface, the second reflecting surface reflecting light from the first reflecting surface forward; and a lens disposed forwardly of the second reflecting surface; wherein the at least one light source is disposed outside the lens with respect to the direction of the optical axis.

To attain the above object, according to a second aspect of the present invention there is provided a lighting fixture for vehicles comprising at least one light source; a first reflecting surface; an intermediate reflecting surface; a second reflecting surface; the first reflecting surface reflecting light from the at least one light source toward the intermediate reflecting surface, the intermediate reflecting surface reflecting light from the first reflecting surface toward the second reflecting surface, the second reflecting surface reflecting light from the intermediate reflecting surface forward; and a lens disposed forwardly of the second reflecting surface; wherein the at least one light source is disposed outside the lens with respect to the direction of the optical axis.

It is preferred in the lighting fixture of the present invention that the second reflecting surface have at least partially a cut for controlling luminous intensity distribution of reflected light.

Preferably, the second reflecting surface is a planar surface. Preferably, the second reflecting surface is a curved surface. Preferably, the intermediate reflecting surface is a planar surface. Preferably, the intermediate reflecting surface is a curved surface. Preferably, a plurality of the light sources, the first reflecting surface and/or the intermediate reflecting surface are provided for a single the second reflecting surface.

It is preferred in the lighting fixture of the present invention that a pair of the second reflecting surfaces be provided one surface above the other, the light source, that the first reflecting surface and/or the intermediate reflecting surface be disposed above the upper one of the pair of second reflecting surfaces, and that the light source, the first reflecting surface and/or the intermediate reflecting surface be disposed below the lower one of the pair of second reflecting surfaces.

It is preferred in the lighting fixture of the present invention that light emitted from the upper light source be reflected by the upper first reflecting surface and/or the upper intermediate reflecting surface to fall on the upper second reflecting surface, and that light emitted by the lower light source is reflected by the lower first reflecting surface and/or the lower intermediate reflecting surface to fall on the lower second reflecting surface.

It is preferred in the lighting fixture of the present invention that light emitted by the upper light source be reflected by the upper first reflecting surface and/or the upper intermediate reflecting surface to fall on the lower second reflecting surface, and that light emitted by the lower light source be reflected by the lower first reflecting surface and/or the lower intermediate reflecting surface to fall on the upper second reflecting surface.

The light source or sources may be LEDs. The light source or sources may thermally be coupled to a fixed portion of the lighting fixture via a housed board.

The lighting fixture for vehicles of the present invention may further comprise a valve, a valve reflecting surface which at a virtual focus gathers light emitted from the valve, and a shield member which conceals the valve and the valve reflecting surface from the front, the valve, the valve reflecting surface and the shield member being adjacent to the light sources, the first reflecting surfaces and the second reflecting surfaces.

In order to accomplish the above object, according to a third aspect of the present invention there is provided a lighting fixture for vehicles having at least one light source, at least one first reflecting surface which receives light from the at least one light source and collimate it into substantially parallel light beams, and at least one second reflecting surface which receives light from the first reflecting surface and reflects it in the direction of illumination of the lighting fixture for vehicles, the lighting fixture comprising at least one composite reflecting surface which integrally includes the first reflecting surface as one side and the second reflecting surface as the other side. The at least one light source is preferably fluorescent tube or an incandescent lamp.

According to the first aspect, light emitted by light sources comprised of LEDs and the like, is reflected respectively by first reflecting surfaces, then reflected by second reflecting surfaces and further radiated forward via lenses.

Moreover, according to the second aspect, light emitted by light sources comprised of LEDs and the like, is reflected respectively by first reflecting surfaces, then reflected by intermediate reflecting surfaces, further reflected by second reflecting surfaces and radiated forward via lenses.

In this case, the majority of light emitted by light sources is reflected by first reflecting surfaces to change into parallel light which is guided onto second or intermediate reflecting surfaces for use for forward radiation, thus providing improved light utilization efficiency. Therefore, fewer light sources are needed to obtain illumination light of the same brightness, thereby reducing cost and possibly reducing produced heat.

Moreover, light sources are provided outside the lens in relation to the direction of the optical axis, which keeps the light sources out of direct sight during illumination when viewed from the front, and which allows only the light-emitting portion reflected by the second reflecting surface to be viewed, thus preventing the light sources from being viewed as luminance spots and giving a feeling of uniform illumination.

Further, when viewed similarly from the front during non-illumination, the light sources remain out of direct sight, thus ensuring improved aesthetical pleasantness during non-illumination, as well.

If the second reflecting surface comprises in part cuts for controlling distribution of reflected light, greater freedom of light distribution control is provided not by taking advantage of light distribution characteristic of the light sources themselves but by controlling distribution of light radiated forward by cuts provided in the second reflecting surface.

With the second reflecting surface shaped in the form of a flat surface, light reflected by the second reflecting surface is nearly parallel light when it falls on the lens, thus providing a uniform light-emitting surface.

With the second reflecting surface shaped in the form of a curved surface, light reflected by the second reflecting surface converges or is diffused as it travels forward and falls on the lens, thus allowing a specific area to be made brighter or a wide light-emitting surface to be formed.

With the intermediate reflecting surface shaped in the form of a flat surface, when light reflected by the first reflecting surface is reflected by the intermediate reflecting surface, it remains parallel light and is guided onto the second reflecting surface.

With the intermediate reflecting surface shaped in the form of a curved surface, when light reflected by the first reflecting surface is reflected by the intermediate reflecting surface, it changes into convergent or diffused light and is guided onto the second reflecting surface.

When a plurality of light sources, first reflecting surfaces and/or intermediate reflecting surfaces are provided for a single second reflecting surface, light from respective light sources is reflected by respective first reflecting surfaces and/or intermediate reflecting surfaces to fall on a common second reflecting surface, thus providing light distribution of high intensity.

When a pair of second reflecting surfaces, one surface above the other, is provided, when a light source, a first reflecting surface and/or an intermediate reflecting surface are provided in the upper side for the upper second reflecting surface and when a light source, a first reflecting surface and/or an intermediate reflecting surface are provided in the lower side for the lower second reflecting surface, arrangement of a pair of lighting fixtures independent of each other, one above another, provides a vertically slimmer light-emitting surface.

When light emitted by the upper light source is reflected by the upper first reflecting surface and/or intermediate reflecting surface to fall on the upper second reflecting surface and when light emitted by the lower light source is reflected by the lower first reflecting surface and/or intermediate reflecting surface to fall on the lower second reflecting surface, the upper and lower second reflecting surfaces reflect light, respectively from the upper and lower light sources, first reflecting surfaces and/or intermediate reflecting surfaces, forward independently of each other.

When light emitted by the upper light source is reflected by the upper first reflecting surface and/or. intermediate reflecting surface to fall on the lower second reflecting surface and when light emitted by the lower light source is reflected by the lower first reflecting surface and/or intermediate reflecting surface to fall on the upper second reflecting surface, the upper and lower second reflecting surfaces reflect light, respectively from the lower and upper light sources, first reflecting surfaces and/or intermediate reflecting surfaces, forward, with two beams of light crossing each other.

This allows a pair of lighting fixtures, independent of each other, to be arranged one above the other, thus providing a vertically slimmer light-emitting surface, ensuring greater design freedom for design and shape of the entire lighting fixture and giving the impression of having a uniform light-emitting surface.

When the light sources are thermally coupled to a lighting fixture's fixed portion via a housed board, heat generated during driving of the light sources is radiated to a fixture's fixed portion such as housing and cover section via the housed board. Consequently, the light sources become extremely hot and therefore reduction in illumination efficiency can be curbed, thus providing a highly intense light-emitting surface.

Moreover, when a valve, a valve reflecting surface which gathers light at a virtual focus and a shield which conceals the valve and the valve reflecting surface from the front, are provided adjacently to the light sources, the first reflecting surfaces and the second reflecting surfaces, light emitted by the valve is reflected by the valve reflecting surface and radiated forward while being gathered toward the virtual focus, apart from illumination light emitted by the light sources, reflected by the first and second reflecting surfaces and radiated forward.

In this case, since the valve and the valve reflecting surface are concealed from the front by the shield, the valve and the valve reflecting surface remain out of direct sight when they are viewed from the front, giving a feeling of uniform illumination, and during non-illumination, the valve and the valve reflecting surface remain out of sight, thus ensuring improved aesthetical pleasantness during non-illumination.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

Preferred embodiments of the present invention will now be described in greater detail with reference to the accompanying drawings.

Note that since the embodiments noted below are suitable and specific examples of the present invention, a variety of technically preferable limitations are provided. However, the scope of the invention is not limited to these embodiments unless otherwise specified in the following description.

Particularly, the lighting fixtures are described as those for vehicles in this description. However, they can be used not only for vehicles but also for other equipment, as noted in the technical fields to which the invention belongs.

Figure 1:
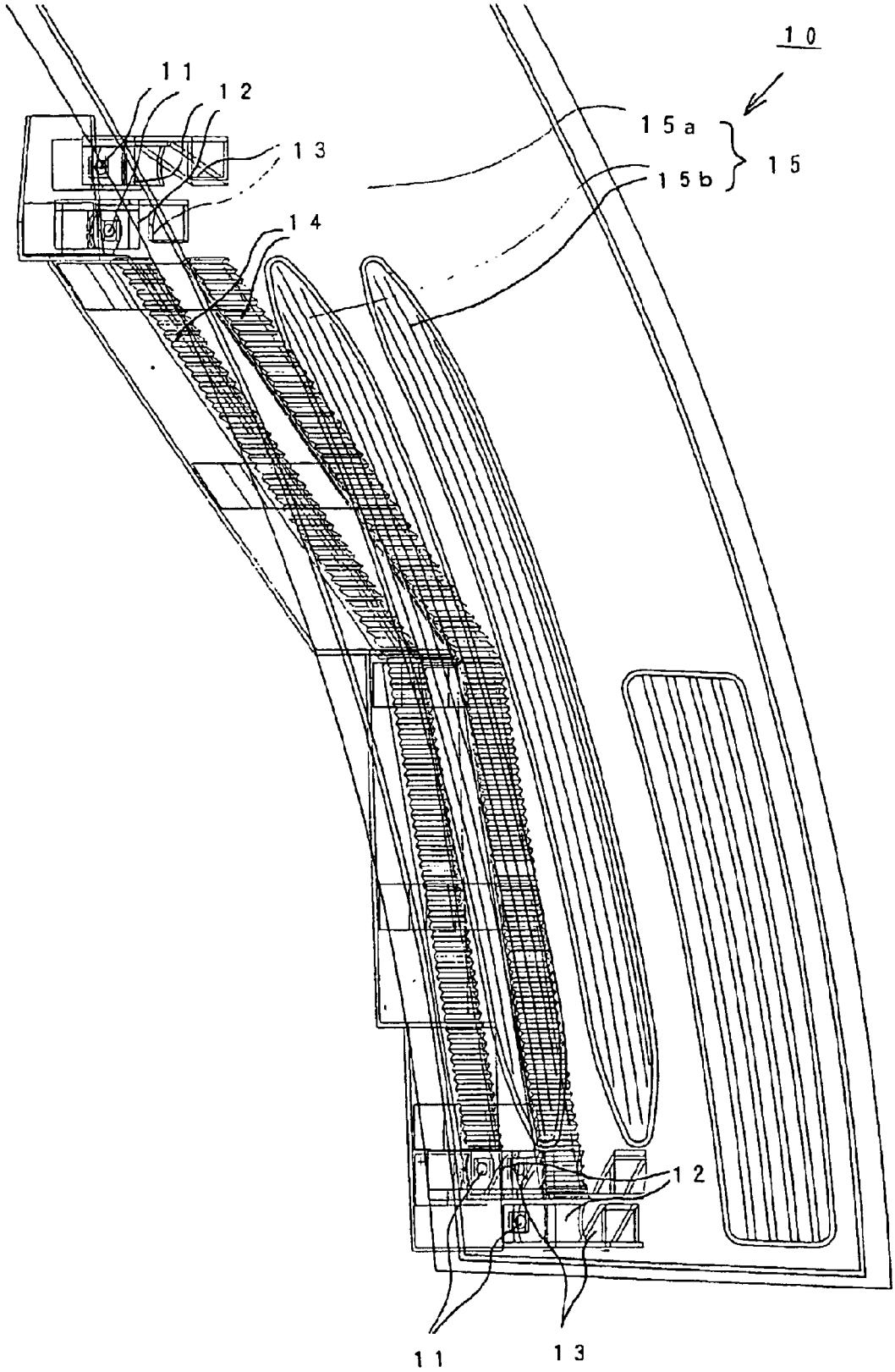
FIG. 1 is a schematic perspective view of the configuration of the first embodiment of a lighting fixture for vehicles to which the present invention applies.
Figure 2:
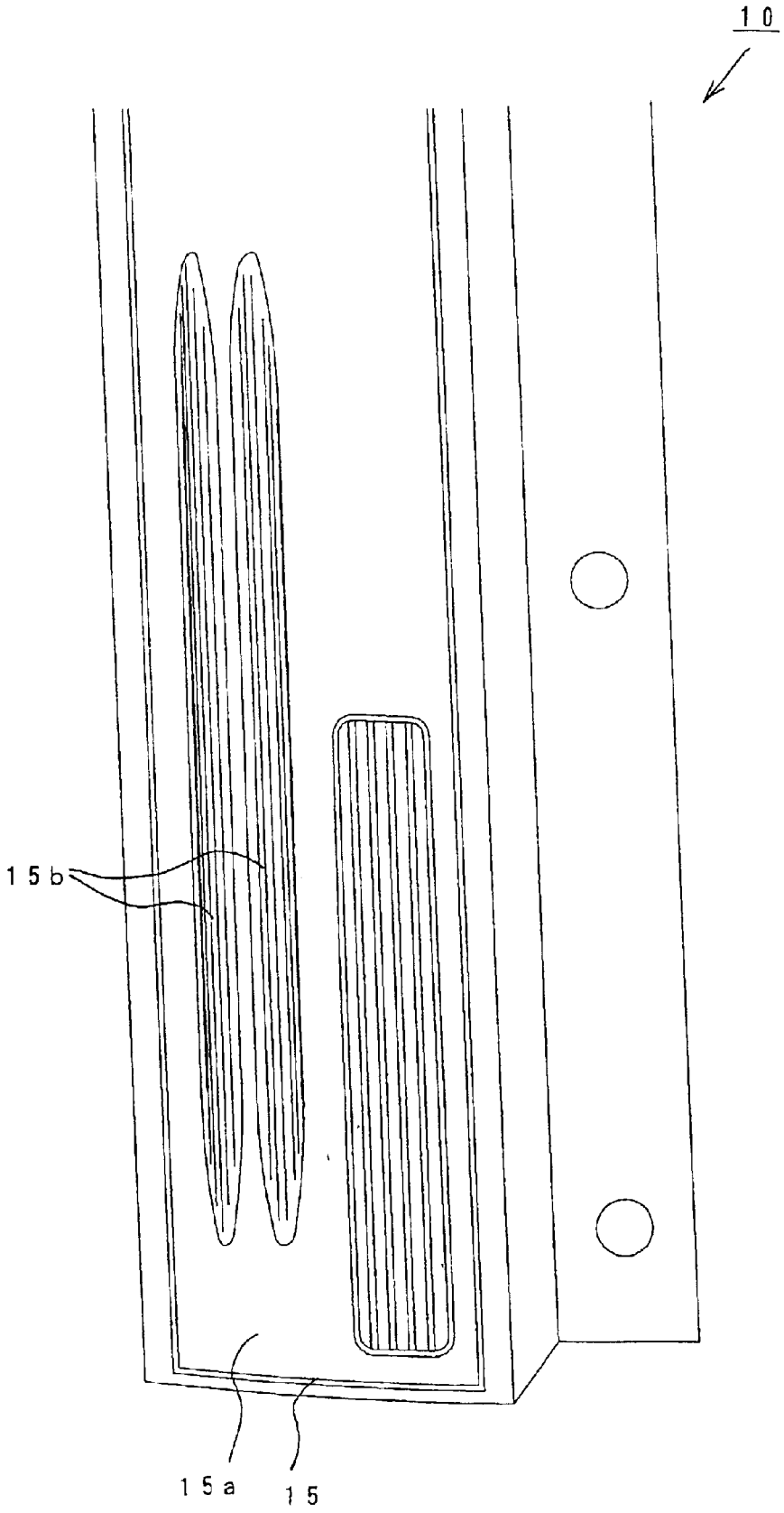
FIG. 2 is a front view of the lighting fixture for vehicles shown in FIG. 1.

FIGS. 1 and 2 show the configuration of the first embodiment of a lighting fixture for vehicles to which the present invention applies.

In FIGS. 1 and 2, a lighting fixture for vehicles 10 is, for example, an automobile's auxiliary lamp comprised of LEDs 11 which are light sources oriented horizontally, first reflecting materials 12 which are provided as if to surround the front of the optical axis, intermediate reflecting materials 13 which reflect light reflected by the first reflecting materials, second reflecting materials 14 which reflect light reflected by the intermediate reflecting materials and a lens 15 provided forwardly of the second reflecting materials 14.

In the illustrations, two each of the LEDs 11 are arranged side by side and one above the other, as a result of which a total of four such LEDs are provided.

Moreover, a first reflecting material 12, an intermediate reflecting material 13 and a second reflecting material 14 are provided for each LED 11.

Figure 3:
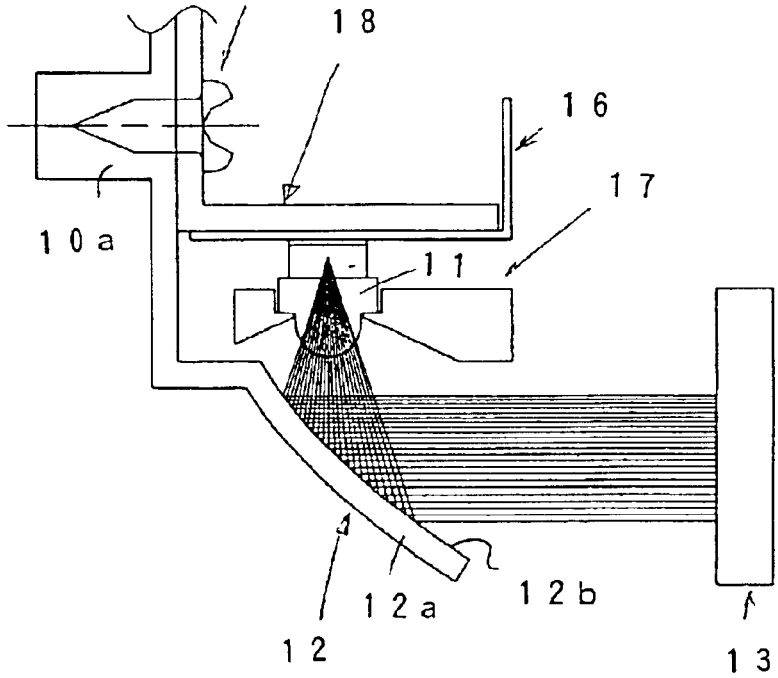
FIG. 3 is a fragmentary expanded horizontal sectional view showing an example of configuration of the areas of the LED, the first reflecting material and the intermediate reflecting material in the lighting fixture for vehicles shown in FIG. 1.
Figure 3:
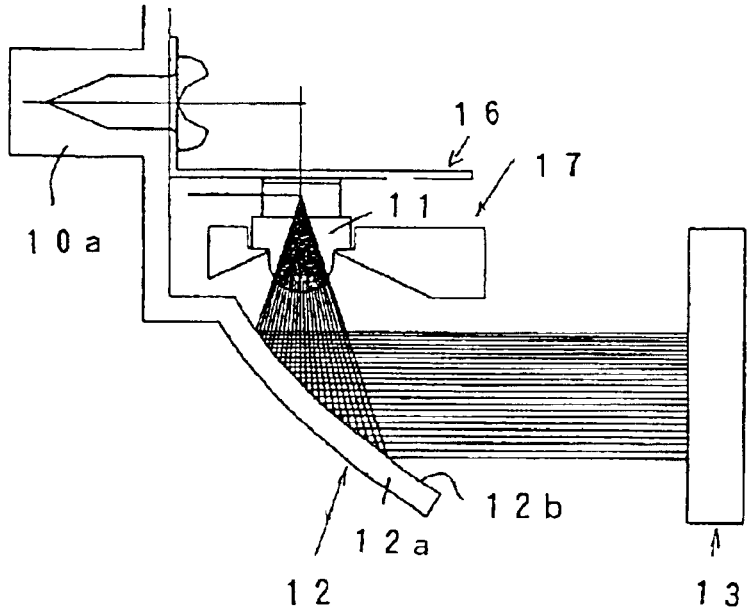
Figure 4:
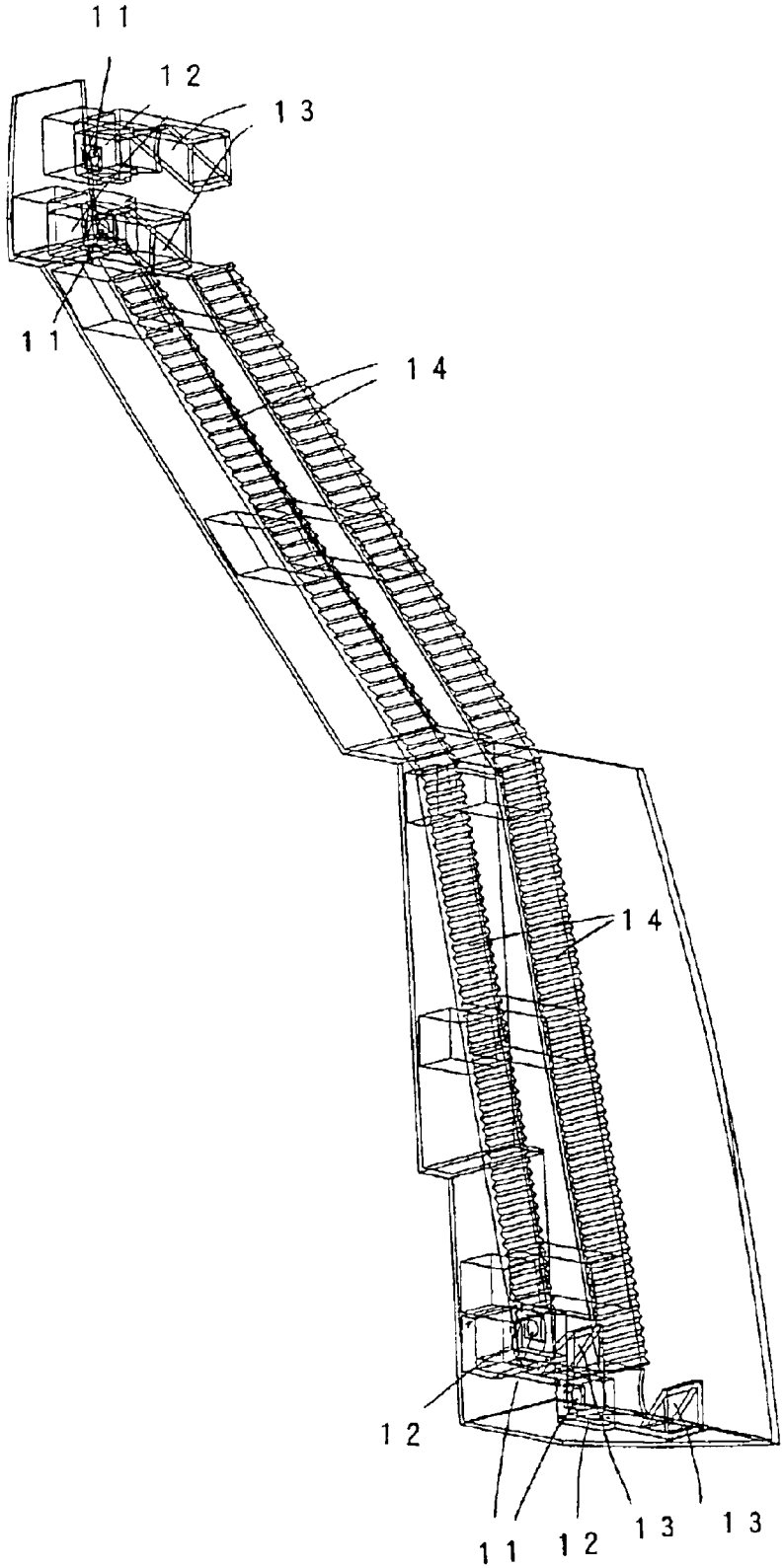
FIG. 4 is a schematic perspective view showing the relationship between the LED, LED, the first reflecting material, the intermediate reflecting material and the second reflecting material in the lighting fixture for vehicles shown in FIG. 1.
Figure 5:
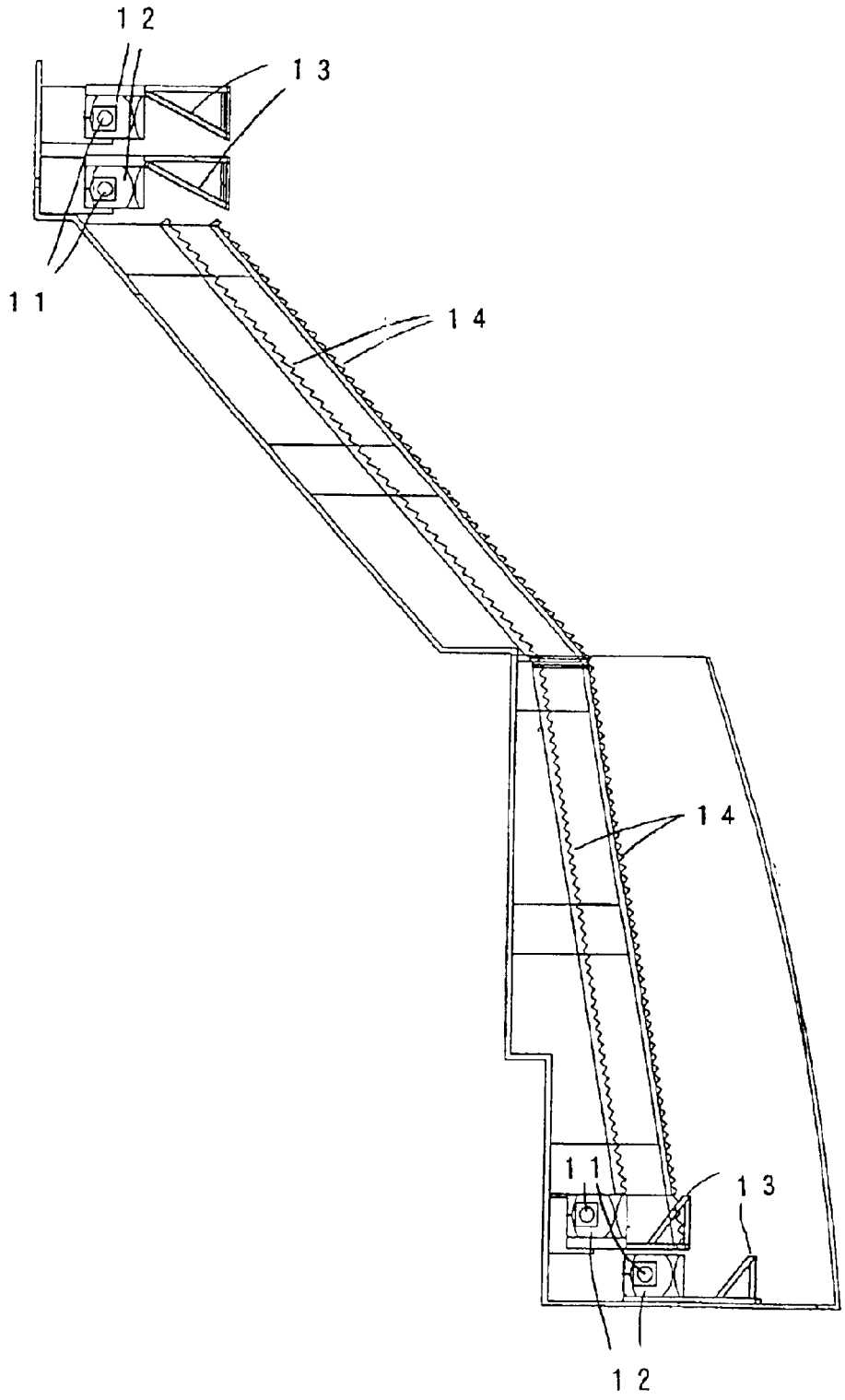
FIG. 5 is a side view of individual materials shown in FIG. 4.
Figure 6:
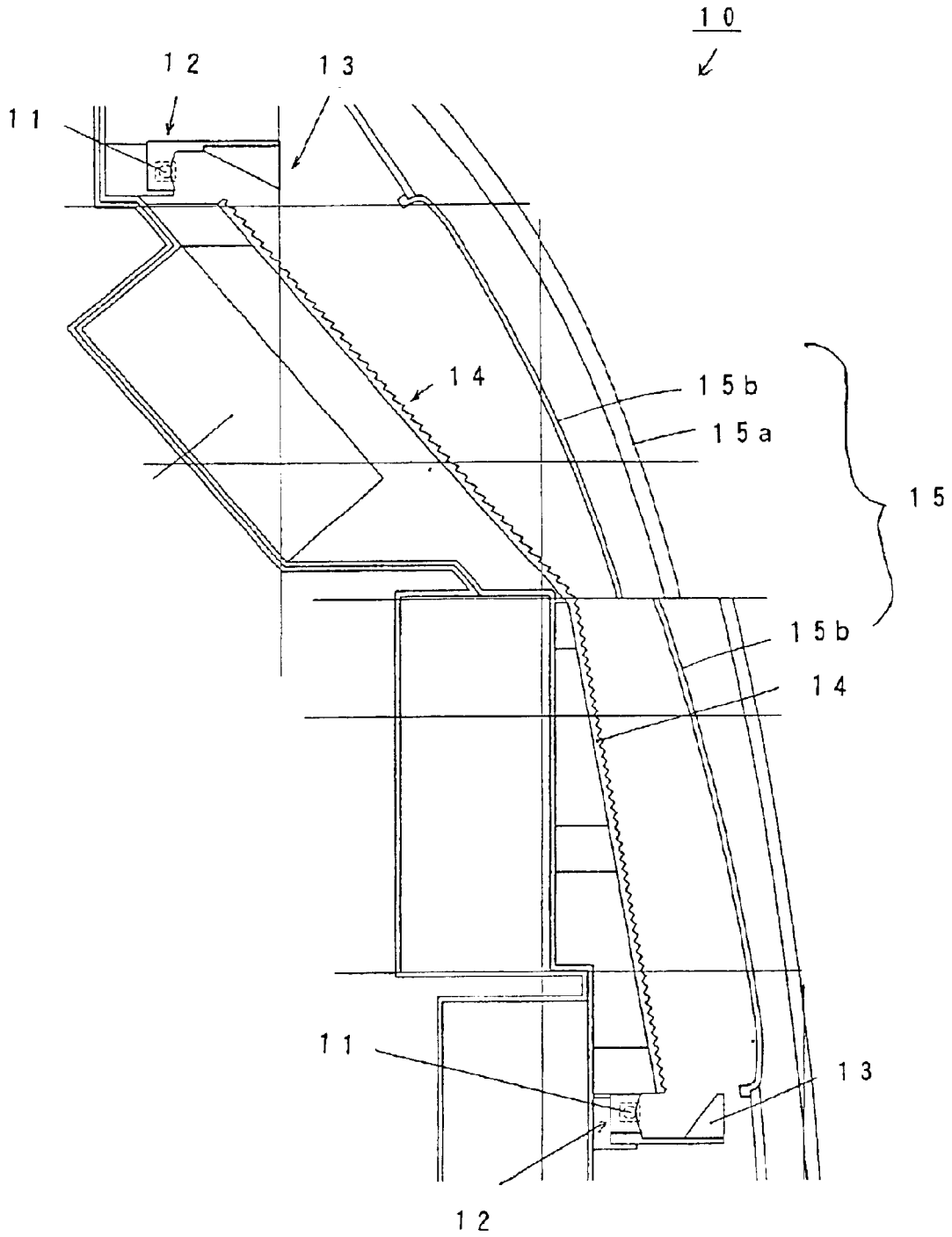
FIG. 6 is a vertical sectional view of the lighting fixture for vehicles shown in FIG. 1.
Figure 7:
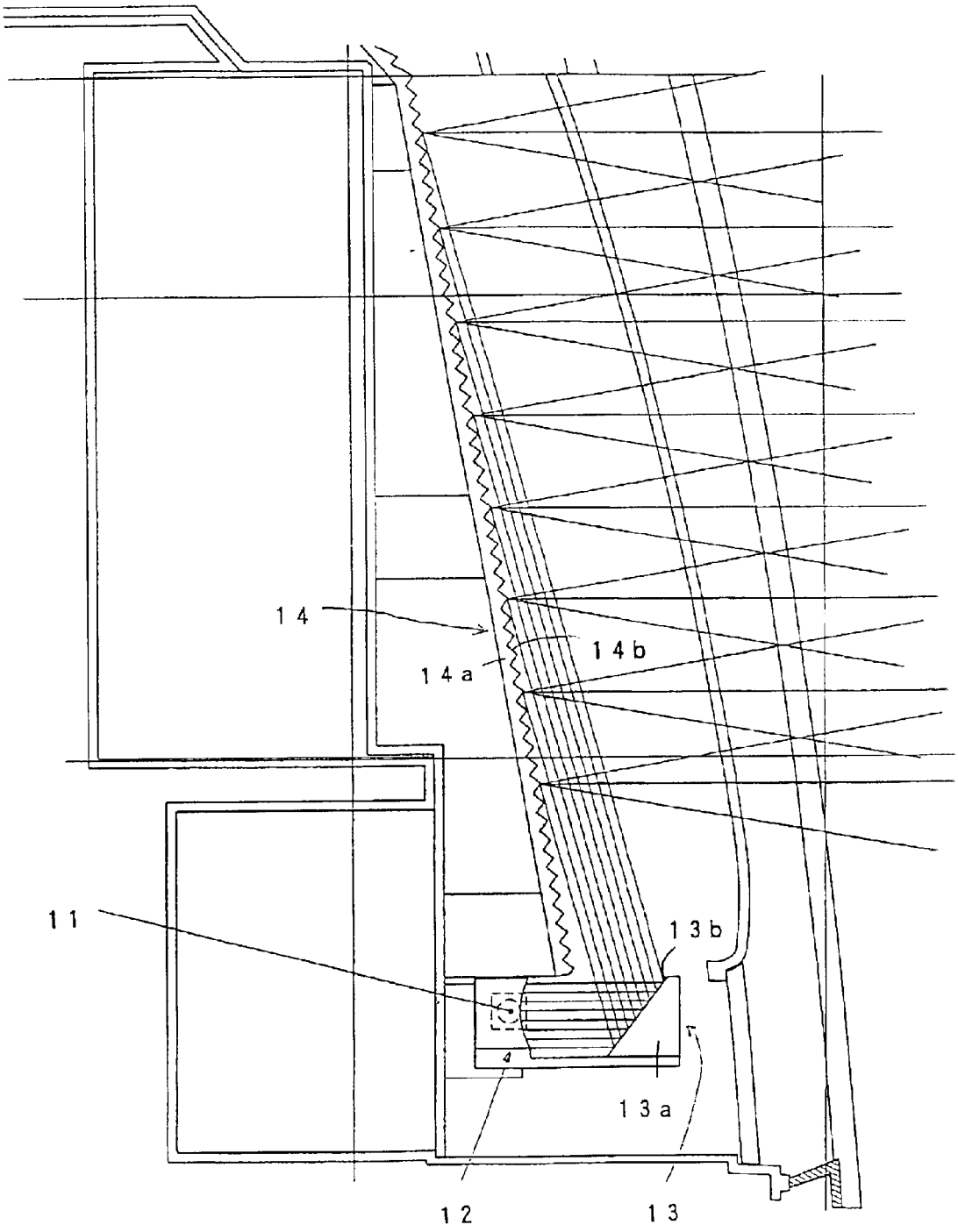
FIG. 7 is a fragmentary expanded vertical sectional view showing the lower end and its surrounding area of the lighting fixture for vehicles shown in FIG. 1.

The LED 11 is mounted horizontally on top of a vertically oriented metal board 16, as shown, for example, in FIG. 3(A), and is designed to emit light sideward, when externally powered, with the optical axis at the center.

Here, the LED is held in place by a locking stay 17 and the metal board 16 is secured to and held at a fixed portion 10*a* such as the housing of the lighting fixture for vehicles 10 via a locking stay 18.

This allows the LED 11 to radiate heat, generated during driving, from the metal board 16 to the fixed portion 10*a* via the locking stay 18.

With the LED 11, note that the metal board 16 may be mounted directly to the fixed portion 10*a*, as shown in FIG. 3(B).

This allows the metal board 16 to radiate heat directly to the fixed portion 10*a*, further improving heat radiation efficiency.

The first reflecting material 12 is configured as a reflecting mirror, as shown in FIGS. 3 to 7, comprised of a main body 12*a* made of a material such as metal or resin and a reflecting membrane 12*b* formed on the surface on the LED 11's side of the main body 12*a* and designed such that the surface of the reflecting membrane 12*b* serves as the first reflecting surface.

In this case, the reflecting membrane 12*b* is formed, for example, by evaporation of a metal such as aluminum; however, it may be formed by other means.

Further, the reflecting membrane 12*b*'s surface which functions as the first reflecting surface, is shaped in the form of a paraboloid of revolution or approximate paraboloid of revolution provided such that the focus is in the proximity of the illumination position of the LED 11 and therefore is designed such that light emitted by the LED 11 is reflected to change it into parallel light.

Note that the reflecting membrane 12*b* is provided so that an optical axis 11*a* of the LED 11 is at its center and is configured such that nearly the entire light beam emitted by the LED 11 is reflected.

The intermediate reflecting material 13 is similarly configured as a reflecting mirror, as shown in FIGS. 4 to 7, comprised of a main body 13*a* made of a material such as metal or resin and a reflecting membrane 13*b* formed on the surface on the opposite side of the first reflecting material 12 of the main body 13*a* and designed such that the surface of the reflecting membrane 13*b* serves as the intermediate reflecting surface.

In this case, the reflecting membrane 13*b* is formed, for example, by evaporation of a metal such as aluminum; however, it may be formed by other means.

Further, the reflecting membrane 13*b*'s surface, which functions as the intermediate reflecting surface, is shaped in the form of a flat surface (or stepped flat surface) so that parallel light reflected by the reflecting membrane 12*b* of the first reflecting material 12 can be reflected toward the adjacent second reflecting material 14.

The second reflecting material 14 is similarly configured as a reflecting mirror, as shown in FIGS. 4 to 7, comprised of a main body 14*a* made of a material such as metal or resin and a reflecting membrane 14*b* formed on the surface on the opposite side of the intermediate reflecting material 13 of the main body 14*a* and designed such that the surface of the reflecting membrane 14*b* serves as the second reflecting surface.

In this case, the reflecting membrane 14*b* is formed, for example, by evaporation of a metal such as aluminum; however, it may be formed by other means.

Moreover, they reflecting membrane 14*b*'s surface, which functions as the second reflecting surface, is shaped in the form of a flat surface as a whole and is also shaped in the form of a stepped flat surface by providing V-shaped horizontal grooves on the surface so that light reflected by the reflecting membrane 13*b* of the intermediate reflecting material 13 can be reflected forward while allowing it to be diffused vertically.

The lens 15 is comprised of an outer lens 15*a* which covers the entire front of the lighting fixture for vehicles 10 and inner lenses 15*b*, each of which is provided forwardly of each of the pairs of the second reflecting materials 14, provided one above the other, as shown in FIGS. 1, 2, 6 and 7.

The outer lens 15*a* is shaped such that the thickness is nearly the same in all areas so that inwardly incident light can practically pass through the lens as is, in the illustrations.

Note also that the inner or outer surface of the inner lenses 15*b* is provided with vertical so-called flute cuts (not illustrated) so that inwardly incident light can be diffused sideward for controlling light distribution.

Here, the LED 11, the first reflecting material 12 and the intermediate reflecting material 13 are provided outside of the second reflecting material 14 in relation to the optical axis of light reflected by the second reflecting material 14.

In this case, since light emitted by the LED 11 is reflected by the first reflecting material 12 to change into parallel light and is guided onto the second reflecting material 14 via the intermediate reflecting material 13, light reflected by the intermediate reflecting material 13 reliably falls on the second reflecting material 14 even if the intermediate reflecting material 13 and the second reflecting material 14 are relatively far apart.

The lighting fixture for vehicles 10 according to this embodiment of the invention is configured as described above, and when light is emitted during illumination as a result of the LED 11 being externally powered, this light is reflected by the reflecting membrane 12*b* of the first reflecting material 12 to change into parallel light and travels toward the intermediate reflecting material 13.

Parallel light which falls on the intermediate reflecting material 13 is reflected by the reflecting membrane 13*b* of the intermediate reflecting material 13 and travels toward the adjacent second reflecting material 14.

Moreover, parallel light, which falls on the second reflecting material 14, is reflected by the reflecting membrane 14*b* of the second reflecting material 14 and is at this time diffused vertically, then travels forward, is diffused horizontally by the inner lenses 15b and radiated forward.

In this case, all light emitted by the LED 11 is reflected by the reflecting membrane 12*b* of the first reflecting material 12, further reflected by the reflecting membrane 13*b* of the intermediate reflecting material 13 and reflected by the reflecting membrane 14*b* of the second reflecting material 14 and then guided forward, thus providing increased light utilization efficiency.

This can reduce the number of LEDs 11 needed, thus reducing cost.

Moreover, since the LED 11 is housed in the metal board 16 and attached via the supporting stay 18 or directly to the fixed portion 10*a*, heat is efficiently radiated to this fixed portion 10*a*, thus preventing the light intensity maintenance rate from lowering and maintaining the LED 11's illumination intensity constant.

Further, since the LED 11 is provided outside the second reflecting material 14 when viewed from the front, the LED 11 remains out of direct sight. Therefore, the LED 11 will not be viewed as a high-intensity luminance spot, as a result of which the second reflecting material 14 can be viewed as a uniform light-emitting portion as a whole, thus giving a feeling of uniform illumination.

Moreover, not only vertical diffusion of light during reflection by the second reflecting material 14 and horizontal diffusion of light during passage through the inner lenses 15*b* but also distribution control of light radiated forward allow the light-emitting surface as a whole formed by the second reflecting material 14 to appear beautifully illuminated, thus providing improved aesthetical pleasantness.

Further, the LED 11 remains out of direct sight when viewed from the front during non-illumination, making the lighting fixture spotless- and heavy-looking and providing improved aesthetical pleasantness.

Figure 8:
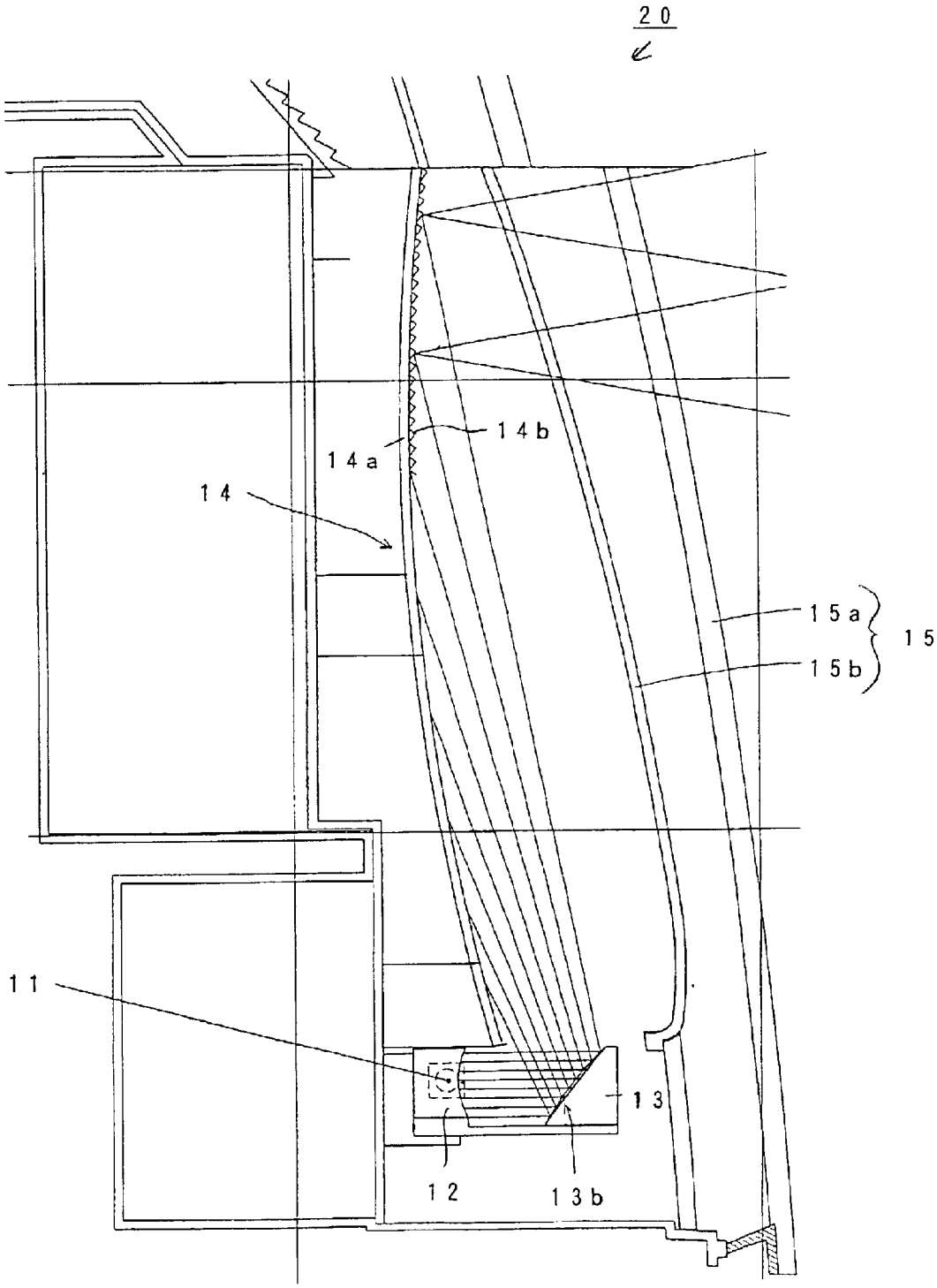
FIG. 8 is a fragmentary expanded vertical sectional view showing the lower end and its surrounding area in the second embodiment of a lighting fixture for vehicles to which the present invention applies.

FIG. 8 shows a configuration of the second embodiment of a lighting fixture for vehicles to which the present invention applies.

In FIG. 8, a lighting fixture 20 is configured nearly similarly to the lighting fixture for vehicles 10 shown in FIGS. 1 and 2 and differs only in the following:

That is, in this case, the surface of the reflecting membrane 13*b* of the intermediate reflecting material 13, which serves as the intermediate reflecting surface, is shaped in the form of a convex surface in the illustration of curved surface.

Correspondingly, the surface of the reflecting membrane 14*b* of the second reflecting material 14, which serves as the intermediate reflecting surface, is shaped in the form of a curved surface having a large radius of curvature as a whole or in the form of a convex surface in the illustration, and also is shaped in the form of a stepped curved surface by providing horizontal V-shaped grooves on the surface so that diffused reflected light from the reflecting membrane 13*b* of the intermediate reflecting material 13 converges while being vertically diffused as it is reflected forward.

According to the lighting fixture for vehicles 20 thus configured, when light is emitted during illumination as a result of the LED 11 being externally powered, this light is reflected by the reflecting membrane 12*b* of the first reflecting material 12 to change into parallel light and travels toward the intermediate reflecting material 13, as with the lighting fixture 10 for vehicles shown in FIGS. 1 and 2.

Parallel light which falls on the intermediate reflecting material 13 is reflected by the reflecting membrane 13*b* of the intermediate reflecting material 13 and travels toward the second reflecting material 14 while being diffused.

Moreover, diffused light, which falls on the second reflecting material 14, is reflected by the reflecting membrane 14*b* of the second reflecting material 14 and is at this time diffused vertically and travels forward while converging, and then is diffused horizontally by the inner lenses 15*b* and radiated forward.

Also in this case, since the lighting fixture for vehicles 20 functions similarly to the lighting fixture for vehicles 10 shown in FIGS. 1 and 2 and since light reflected by the intermediate reflecting material 13 is diffused, the reflecting membrane 14*b* of the second reflecting material 14 can be made larger. Consequently, since the light-emitting surface formed by the second reflecting material 14 can be made larger and since light, reflected by the second reflecting material 14, is radiated forward while converging, it is possible to provide increased illumination intensity at a forward position which is relatively far away.

Figure 9:
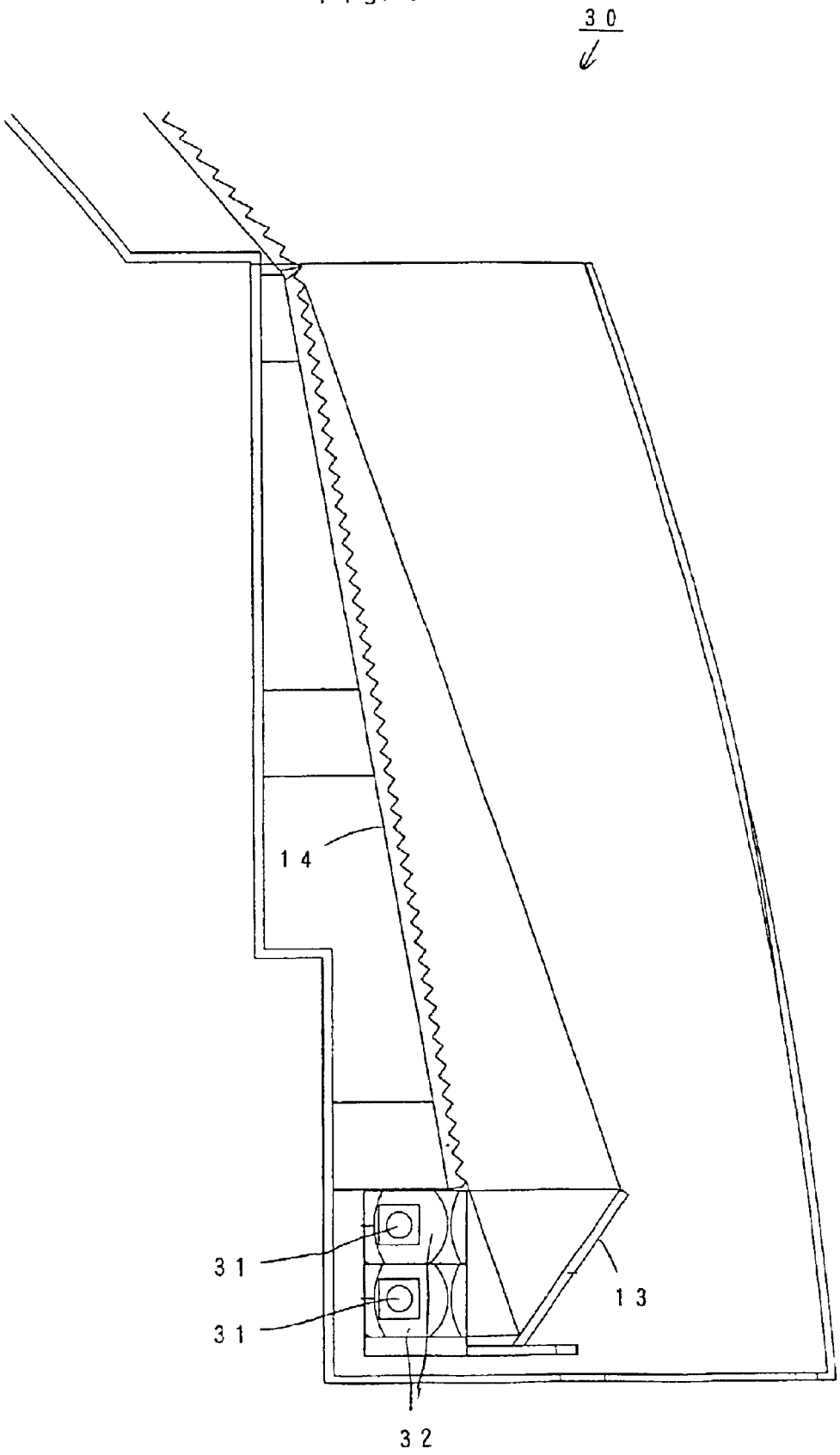
FIG. 9 is a fragmentary expanded vertical sectional view showing the lower end and its surrounding area in the third embodiment of a lighting fixture for vehicles to which the present invention applies.

FIG. 9 shows a configuration of the third embodiment of a lighting fixture for vehicles to which the present invention applies.

In FIG. 9, a lighting fixture 30 is configured nearly similarly to the lighting fixture for vehicles 10 shown in FIGS. 1 and 2 and differs only in the following:

That is, in this case, two LEDs 31 and two first reflecting materials 32 are provided for each intermediate reflecting material 13.

Both the LEDs 31 and the first reflecting materials 32 are arranged one above the other and side by side, and light emitted by each LED 31 is reflected by the corresponding first reflecting material 32 to change into parallel light, is reflected by the common intermediate reflecting material 13 and reflected forward by the common second reflecting material 14.

According to the lighting fixture for vehicles 30 thus configured, when light is emitted during illumination as a result of the LED 11 being externally powered, this light is reflected by the reflecting membrane 12*b* of the first reflecting material 12 to change into parallel light and travels toward the intermediate reflecting material 13, as with the lighting fixture for vehicles 10 shown in FIGS. 1 and 2.

Parallel light which falls on the intermediate reflecting material 13 is reflected by the reflecting membrane 13*b* of the intermediate reflecting material 13 and travels toward the second reflecting material 14 while being diffused.

Moreover, diffused light, which falls on the second reflecting material 14, is reflected by the reflecting membrane 14*b* of the second reflecting material 14 and is at this time diffused vertically and travels forward while converging, and then is diffused horizontally by the inner lenses 15*b* and radiated forward.

In this case, since light from two LEDs 31 falls on a second reflecting material 14, the intensity of light radiated forward by the second reflecting material 14 is nearly twofold, thus providing highly intense light distribution.

Figure 10:
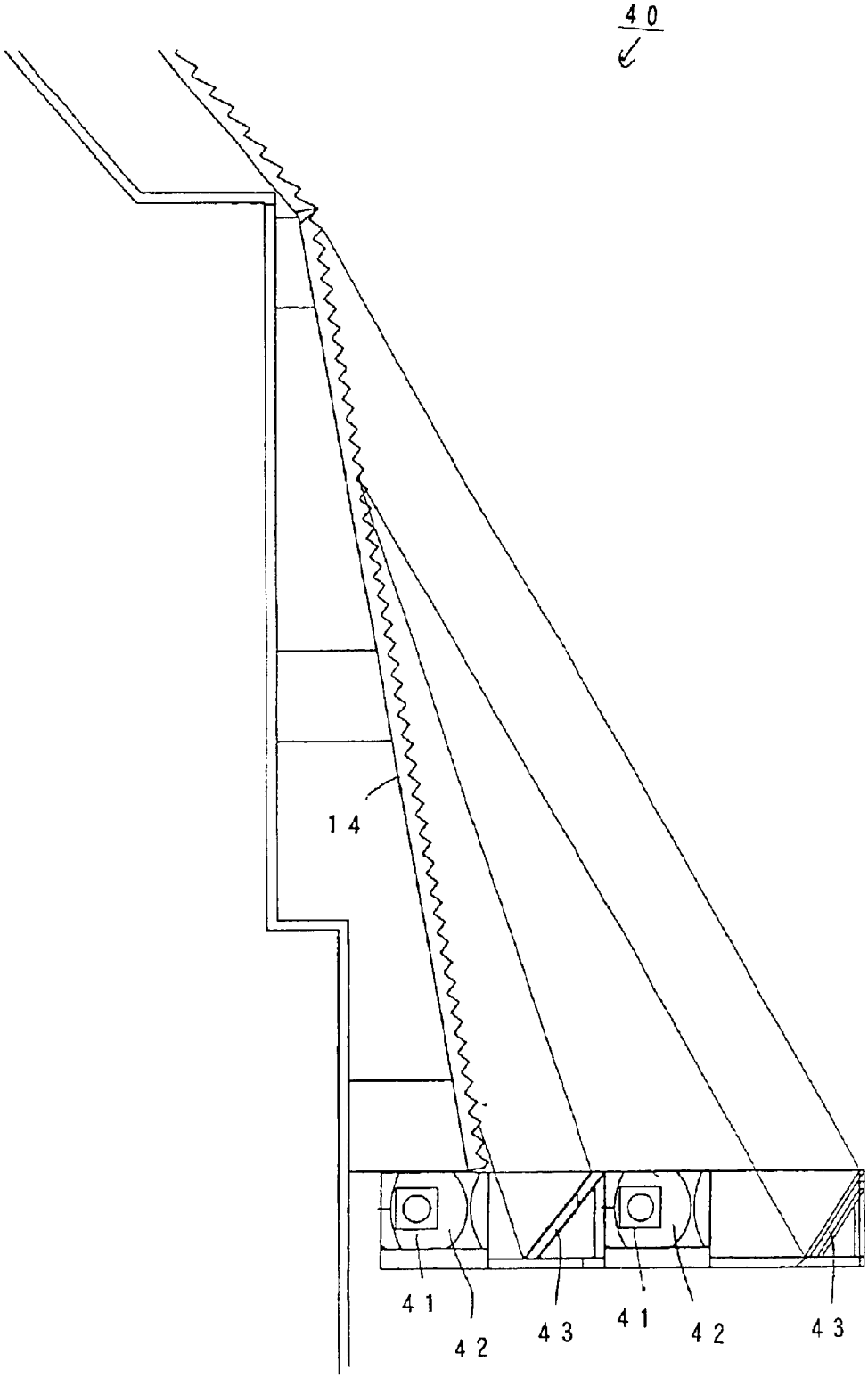
FIG. 10 is a fragmentary expanded vertical sectional view showing the lower end and its surrounding area in the fourth embodiment of a lighting fixture for vehicles to which the present invention applies.

FIG. 10 shows a configuration of the fourth embodiment of a lighting fixture for vehicles to which the present invention applies.

In FIG. 10, a lighting fixture 40 is configured nearly similarly to the lighting fixture for vehicles 10 shown in FIGS. 1 and 2 and differs only in the following:

That is, in this case, two LEDs 41, two first reflecting materials 42 and two intermediate reflecting materials 43 are provided for each intermediate reflecting material 14.

The LEDs 41, the first reflecting materials 42 and the intermediate reflecting materials 43 are arranged one in front of the other, and light emitted by each LED 41 is reflected by the corresponding first reflecting material 42 to change into parallel light, is reflected by the corresponding intermediate reflecting material 43 and reflected forward by the common second reflecting material 14.

According to the lighting fixture for vehicles 40 thus configured, it functions similarly to the lighting fixture for vehicles 10 shown in FIGS. 1 and 2 and since light from two LEDs 41 falls on a second reflecting material 14, the intensity of light radiated forward by the second reflecting material 14 is nearly twofold, thus providing highly intense light distribution as with the lighting fixture for vehicles 30 shown in FIG. 9.

Figure 11:
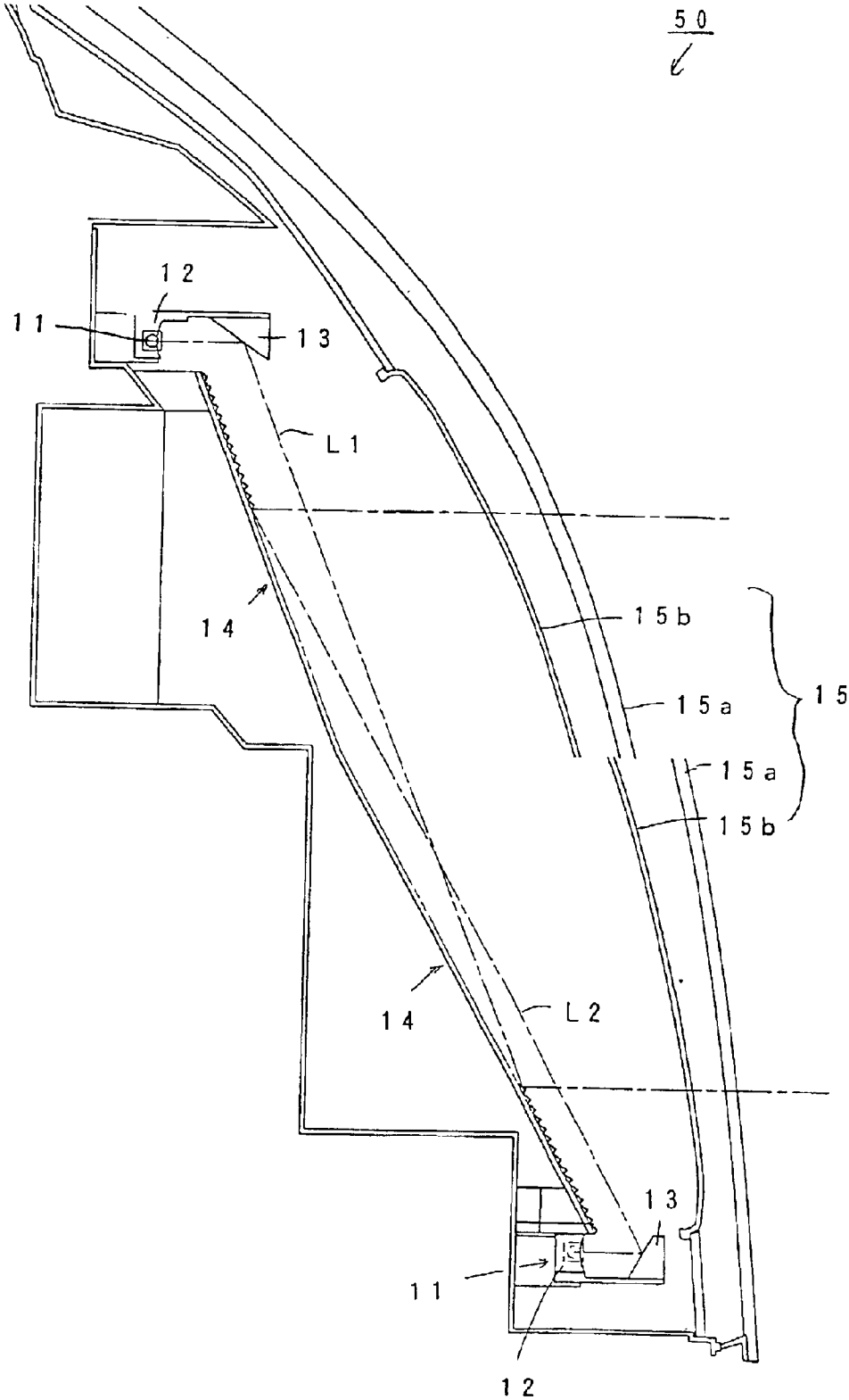
FIG. 11 is a vertical sectional view of the fifth embodiment of a lighting fixture for vehicles to which the present invention applies.

FIG. 11 shows a configuration of the fifth embodiment of a lighting fixture for vehicles to which the present invention applies.

In FIG. 11, a lighting fixture 50 is configured nearly similarly to the lighting fixture for vehicles 10 shown in FIGS. 1 and 2 and differs only in the following:

That is, in this case, upper and lower LEDs 11, first reflecting materials 12, intermediate reflecting materials 13 and second reflecting materials 14 are paired. Light L1 emitted by the upper LED 11 is reflected by the upper first reflecting surface 12 and the upper intermediate reflecting surface 13 to fall on the lower second reflecting surface 14, and light L2 emitted by the lower LED 11 is reflected by the lower first reflecting surface 12 and the lower intermediate reflecting surface 13 to fall on the upper second reflecting surface 14.

According to the lighting fixture for vehicles 50 thus configured, it functions similarly to the lighting fixture for vehicles 10 shown in FIGS. 1 and 2 and since light L1 and L2 from the upper and lower LEDs 11 falls respectively on the lower and upper second reflecting materials 14 while crossing each other, it is possible to keep an ample distance between the intermediate reflecting materials 13 and the second reflecting materials 14. Consequently, it is possible to meet restrictions such as design demands for the lighting fixture for vehicles 50 and automobile's body shape and effectively improve the fixture's impression of uniform illumination.

Figure 12:
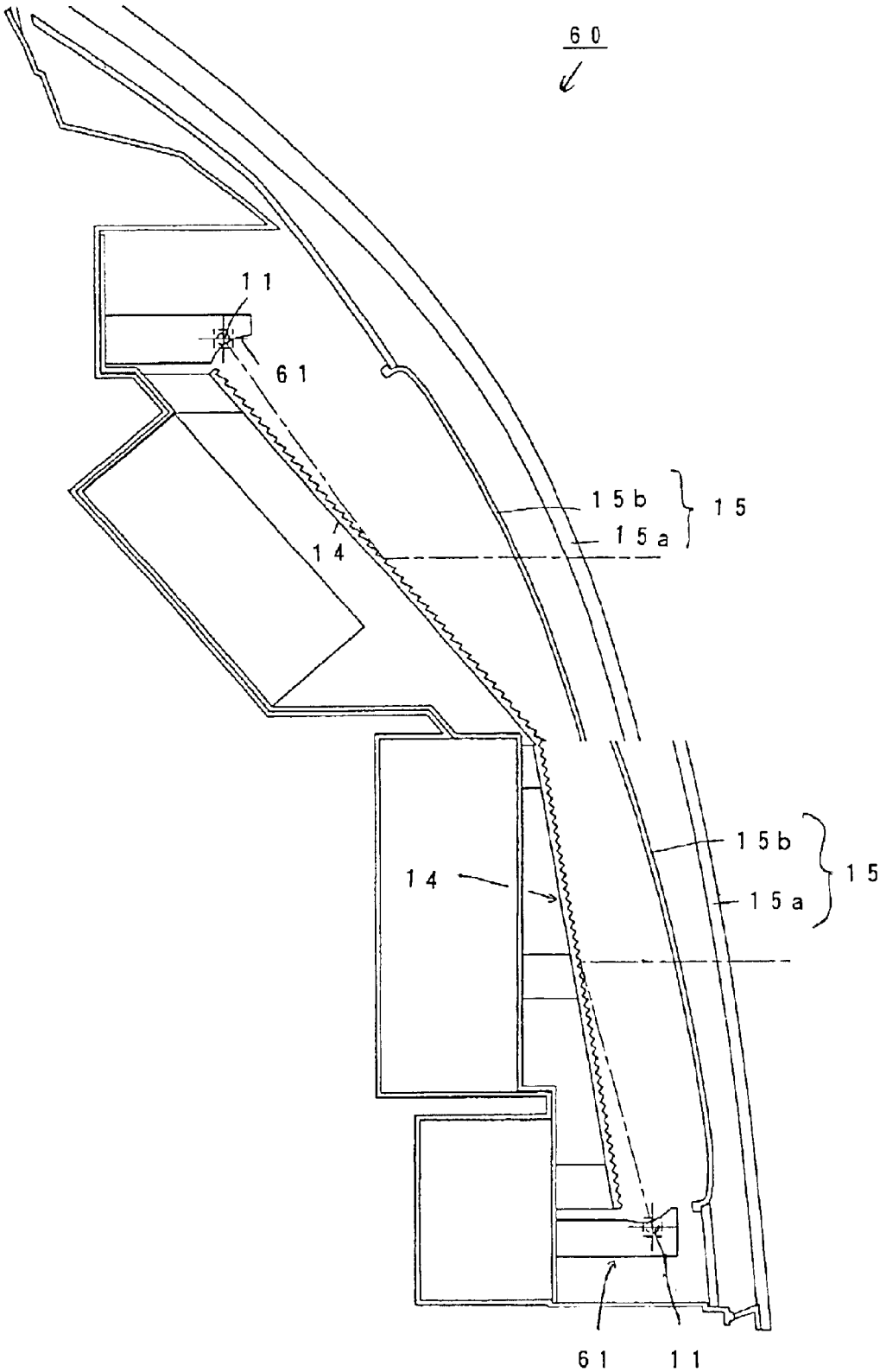
FIG. 12 is a vertical sectional view of the sixth embodiment of a lighting fixture for vehicles to which the present invention applies.

FIG. 12 shows a configuration of the sixth embodiment of a lighting fixture for vehicles to which the present invention applies.

In FIG. 12, a lighting fixture 60 is configured nearly similarly to the lighting fixture for vehicles 10 shown in FIGS. 1 and 2 and differs only in the following:

That is, in this case, there are no intermediate reflecting materials 13, and light emitted by each LED 11 is reflected by a first reflecting material 61 to change into parallel light and is guided onto a second reflecting material 14.

Note that in this case each of the first reflecting materials 61 is positioned properly so that it can reflect light from the LED 11 toward the second reflecting material 14.

According to the lighting fixture for vehicles 60 thus configured, it functions similarly to the lighting fixture for vehicles 10 shown in FIGS. 1 and 2 and since light emitted by each LED 11 is reflected by the first reflecting material 61 to travel directly toward the second reflecting material 14, reduction in light intensity during reflection by the intermediate reflecting material 13 is eliminated, thus providing improved intensity of light radiated forward and requiring fewer components for reduced component and assembly costs.

Figure 13:
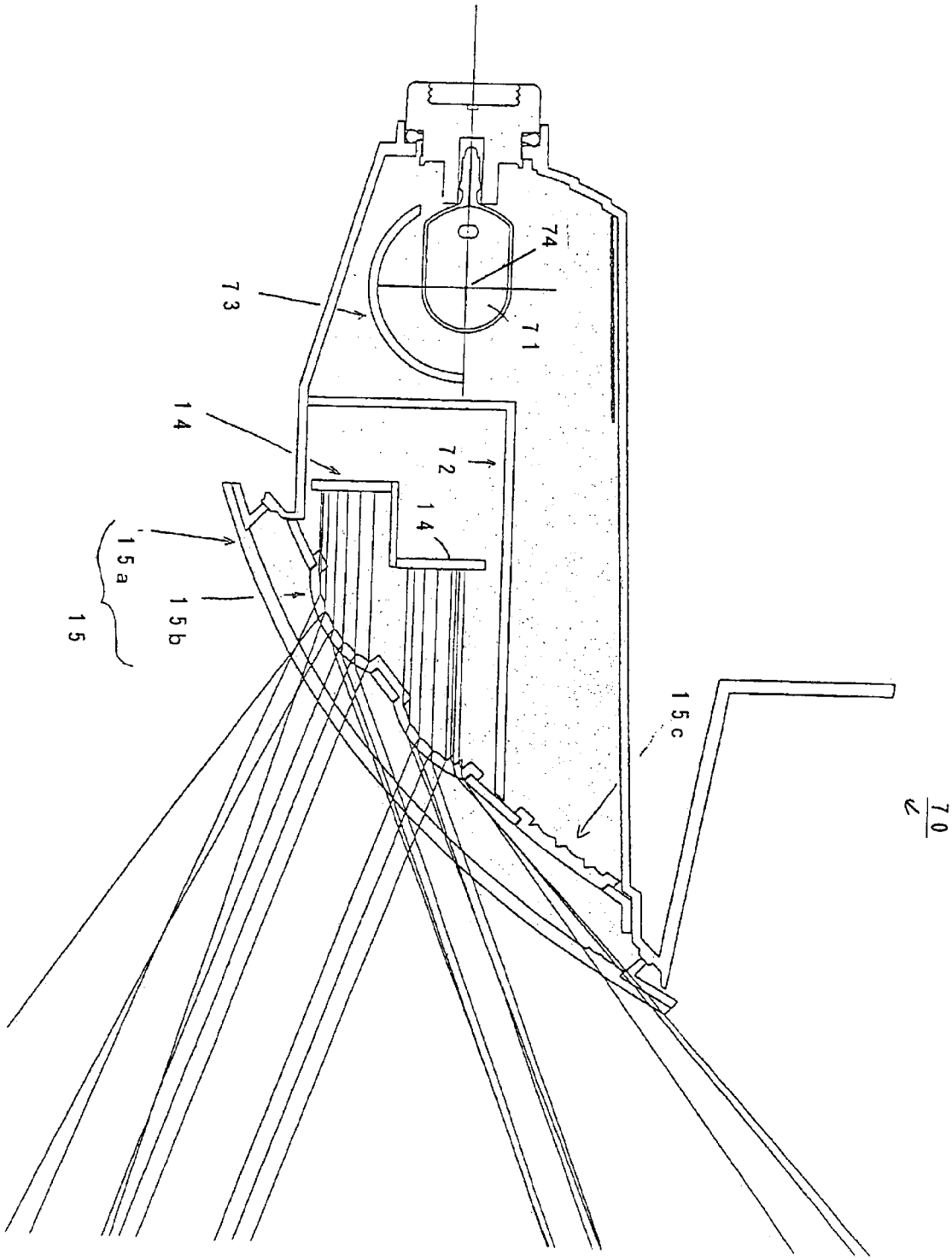
FIG. 13 is a horizontal sectional view of the seventh embodiment of a lighting fixture for vehicles to which the present invention applies.

FIG. 13 shows a configuration of the seventh embodiment of a lighting fixture for vehicles to which the present invention applies.

In FIG. 13, a lighting fixture 70 is configured nearly similarly to the lighting fixture for vehicles 10 shown in FIGS. 1 and 2 and differs only in the following:

That is, in this case, a valve 71 is located in the rear of second reflecting materials 14, and a cover 72 is provided which conceals the valve 71 from the front.

Further, a semi-spherical valve reflecting material 73, which gathers valve 71's light sideward at a virtual focus 74, is provided on the side of the valve 71.

Correspondingly, a lens 15 comprises a turn inner lens 15*c*, inside an outer lens 15*a* and side by side with an inner lens 15*b*, which controls distribution of light reflected and radiated forward by materials ranging from the valve 71 to the valve reflecting material 73.

According to the lighting fixture for vehicles 70 thus configured, it functions similarly to the lighting fixture for vehicles 10 shown in FIGS. 1 and 2, and light emitted by each LED 11 is reflected by a first reflecting material 12, intermediate reflecting material 13 and second reflecting material 14 to pass through the inner lens 15*b* and is radiated forward, and light emitted by the valve 71 is reflected by the valve reflecting material 73 to be radiated forward while converging to its virtual focus 74, and when it passes through the turn inner lens 15*c*, it is properly distribution-controlled and then radiated forward.

In this case, an illumination function by the valve 71 is provided in addition to the functions available with the lighting fixture for vehicles 10 shown in FIGS. 1 and 2.

Moreover, since the valve 71 comprises the valve reflecting material 73, it offers greater light utilization efficiency, and since it is concealed by the cover from the front, the valve 71 is positioned behind the cover 72 when viewed from the front, thus keeping the valve 71 out of direct sight. Therefore, the valve 71 will not be viewed as a high-intensity luminance spot, and the entire turn inner lens 15*c* will be viewed as a uniform light-emitting portion, thus allowing the valve 71 to give a feeling of uniform illumination, as well.

Figure 14:
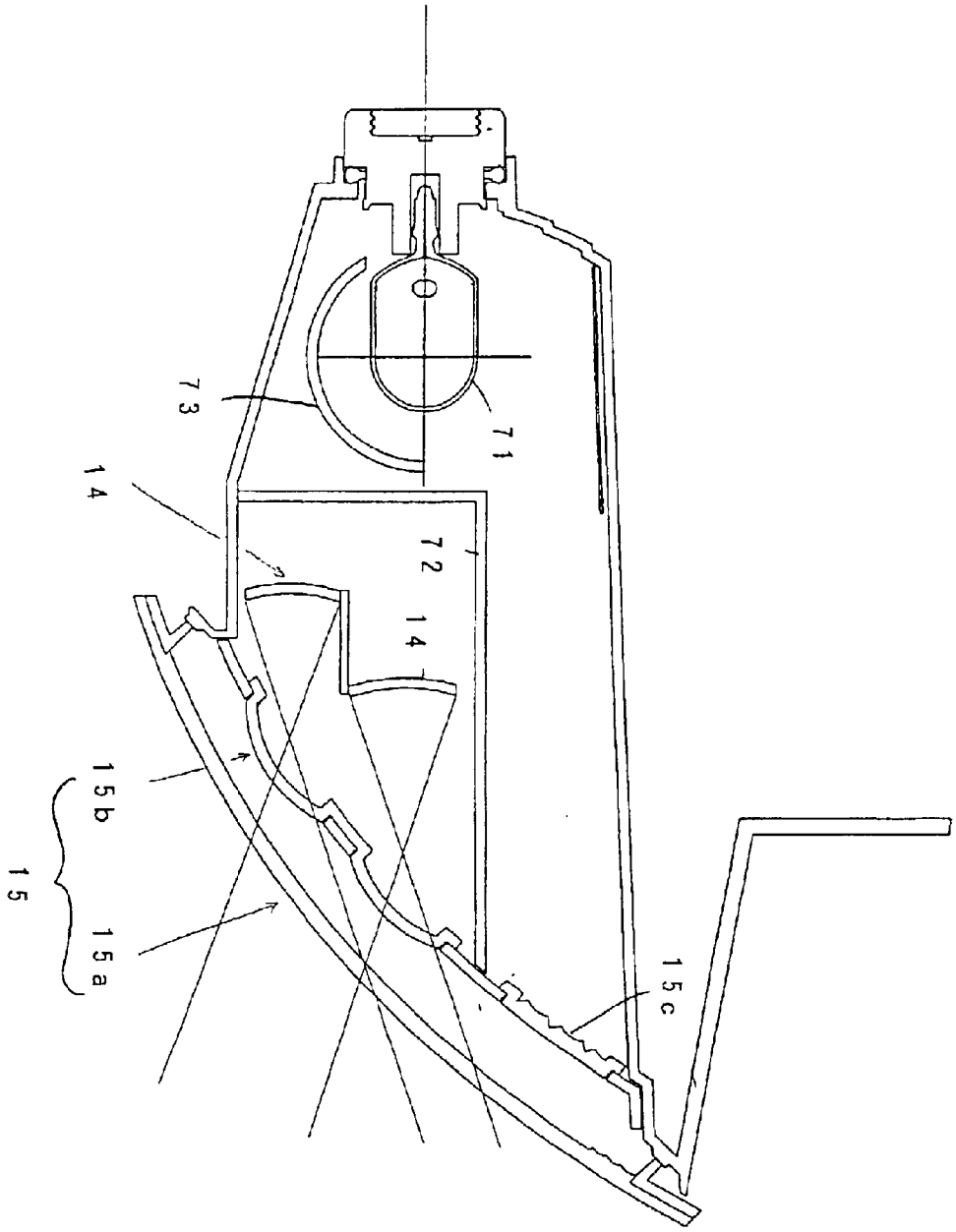
FIG. 14 is a horizontal sectional view of the eighth embodiment of a lighting fixture for vehicles to which the present invention applies.

FIG. 14 shows a configuration of the eighth embodiment of a lighting fixture for vehicles to which the present invention applies.

In FIG. 14, a lighting fixture 80 is configured nearly similarly to the lighting fixture for vehicles 70 shown in FIG. 13 and differs only in the following:

That is, in this case, each of the second reflecting materials 14 is shaped in the form of a concave surface having a large radius of curvature as a whole similarly to the reflecting materials 14 of the lighting fixture for vehicles 20 in FIG. 8 and the inner lens 15*b* of the lens 15 does not comprise the flute cuts.

According to the lighting fixture for vehicles 80 thus configured, it functions similarly to the lighting fixture for vehicles 70 shown in FIG. 13, and light reflected by the second reflecting materials 14 is radiated forward while converging without being horizontally diffused. This allows light distribution control to be performed only through vertical diffusion by the second reflecting materials 14, and the flute cuts of the inner lens 15*b* cannot be visually identified when viewed from the front, making the lighting fixture brand-new-looking.

In the embodiments, the lighting fixtures for vehicles 10 through 80 for use, for example, as automobile's auxiliary lamps are described, however, it is obvious, that the present invention is not limited to these applications and that the invention can be applied to lighting fixtures for vehicles employed as a variety of signal lamps such as tail lamp, brake lamp, turn signal and high-mount stop lamp and lighting fixtures used as illumination and other lamps.

Figure 15:
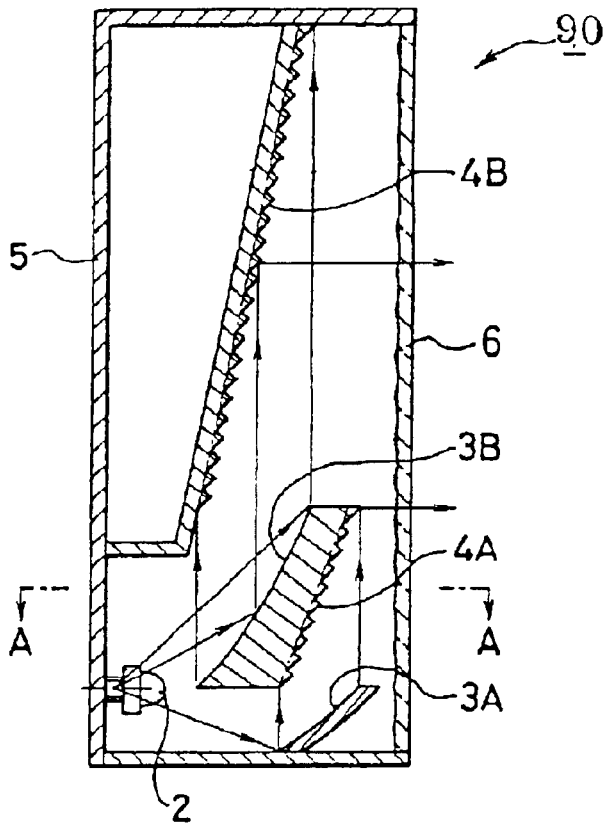
FIG. 15 is a horizontal sectional view of the ninth embodiment of a lighting fixture for vehicles to which the present invention applies.

FIG. 15 shows a configuration of the ninth embodiment of a lighting fixture for vehicles to which the present invention applies.

Figure 16:
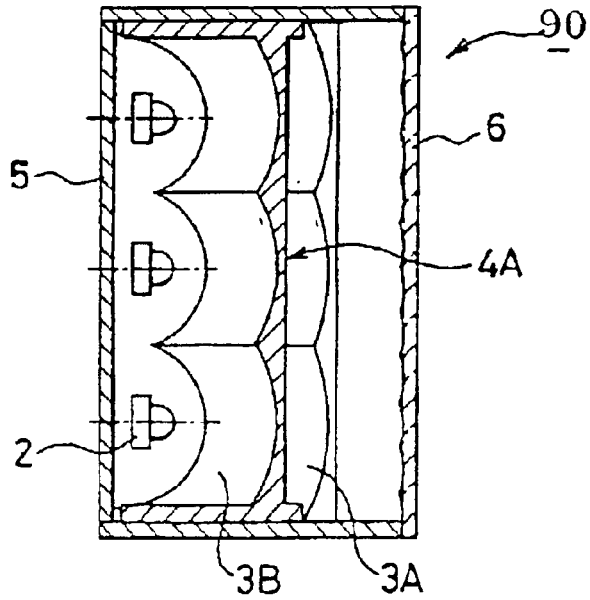
FIG. 16 is a sectional view taken along line A—A of FIG. 15.

Those shown in FIGS. 15 and 16 are the ninth embodiment of a lighting fixture for vehicles associated with this invention and are illustrations which demonstrate that an LED or LEDs are used as light sources 11. Two first reflecting surfaces in the form of a paraboloid of revolution, one of which is a lower first reflecting surface 3A and the other of which is an upper first reflecting surface 3B, are provided forwardly of the light source 11 in the direction of the source's illumination, each of whose focus is the light source 11 and whose axis of rotation is the approximate vertical direction. Note that, in this description, directions such as vertical and horizontal directions are described with reference to a lighting fixture for vehicles 90 as it is mounted to a vehicle.

At this time, since the lower first reflecting surface 3A and upper first reflecting surface 3B receive light from the same light source 11, received light quantities are properly distributed so that, for example, the lower first reflecting surface 3A receives light from the lower half portion of the light source 11 as divided by a horizontal line passing through the center of the light source 11 while the upper first reflecting surface 3B receives light from the upper half portion of the light source 11.

Such a configuration allows both the lower first reflecting surface 3A and upper first reflecting surface 3B to generate reflected light headed upward in the approximately vertical direction. Consequently, a lower second reflecting surface 4A and upper second reflecting surface 4B are provided respectively for the lower first reflecting surface 3A and upper first reflecting surface 3B, and light from the first reflecting surfaces 3A and 3B is reflected in the direction of illumination of the lighting fixture for vehicles 90 for conversion.

Here, since the lower first reflecting surface 3A and upper first reflecting surface 3B receive light from the same light source 11 and since both of them generate parallel light headed upward, the upper first reflecting surface 3A and the lower second reflecting surface 4A are highly likely to cause interference due to their positions. If this is avoided, problems such as insufficient light-emitting area of the lighting fixture for vehicles 90—the area determined by the second reflecting surfaces 4A and 4B—may occur.

In the present invention, for this reason, the lower second reflecting surface 4A is provided in the back of and integrally with the upper first reflecting surface 3B, and such integration prevents interference caused by the upper first reflecting surface 3B and the lower second reflecting surface 4A due to their positions. Note also that such a configuration renders the positions of the lower second reflecting surface 4A and the upper second reflecting surface 4B in the lengthwise direction (in the direction of depth) approximately equal as they are installed inside a housing 5, thus making it possible to produce a thinner housing 5.

Next, the functions and effects of the lighting fixture for vehicles 90 are described. Firstly, as described above, since the first reflecting surfaces 3A and 3B and the second reflecting surfaces 4A and 4B are arranged in the approximately vertical direction and in a straight line, it is possible to make the housing 5 slimmer. More specifically, a conventional lighting fixture for vehicles must be at least some 80 mm in depth while the depth of the lighting fixture for vehicles 90 can be some 40 mm, thus making it possible to reduce the depth approximately in half.

Moreover, since the light source 11 in the lighting fixture for vehicles 90 is provided with the first reflecting surfaces 3A and 3B, all light from the light source 11 is trapped by these first reflecting surface 3A and 3B, thus preventing light which falls on an outer lens 15*a* immediately afterwards from being generated. Therefore, the outer lens 15*a* is free of exceptionally bright portions when viewed during illumination, thereby allowing it to be illuminated at uniform brightness and providing improved aesthetical pleasantness during illumination.

Figure 17:
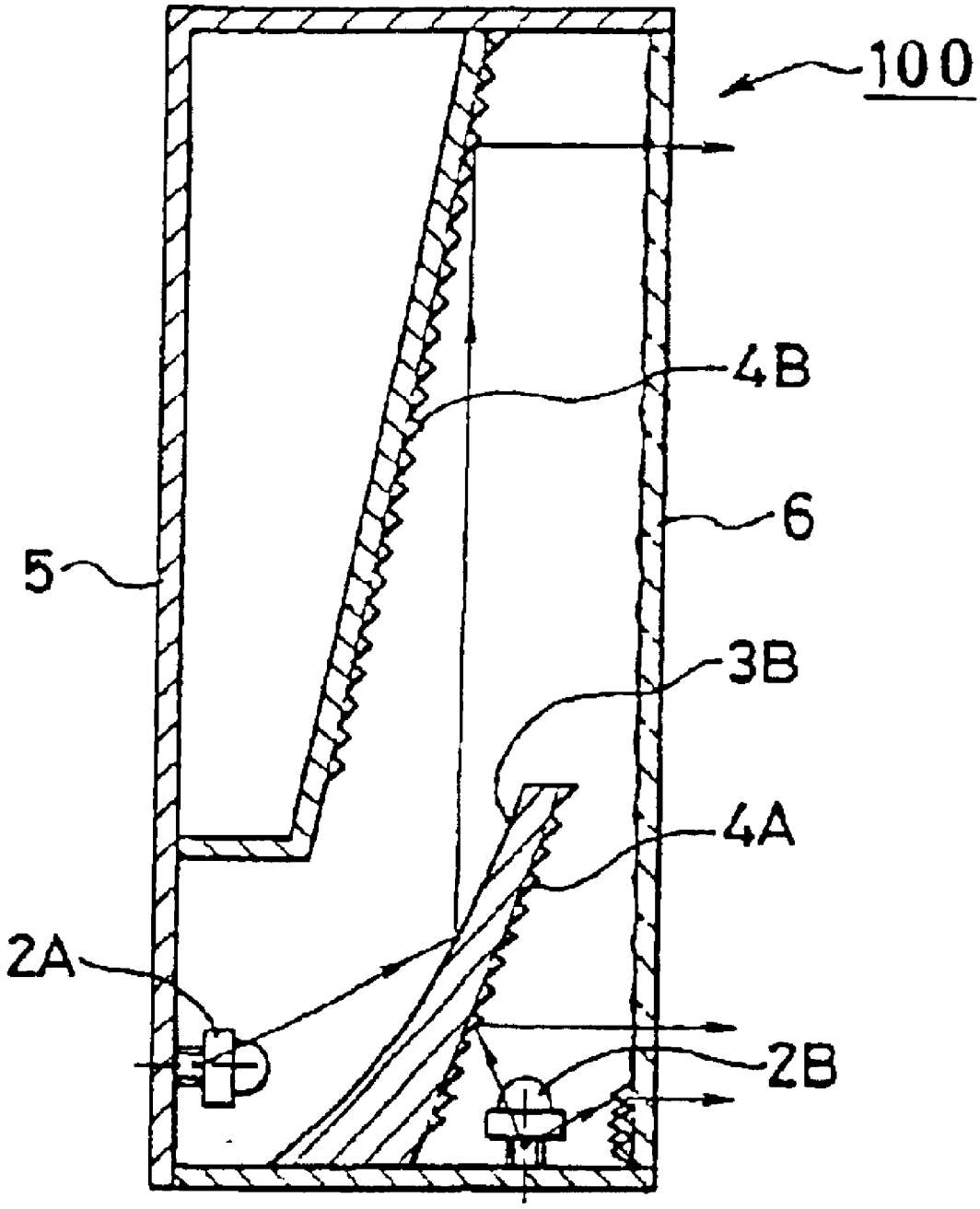
FIG. 17 is a horizontal sectional view of the tenth embodiment of a lighting fixture for vehicles to which the present invention applies.

FIG. 17 shows the tenth embodiment of a lighting fixture for vehicles of the present invention. In the ninth embodiment, light does not reach the back of the lower first reflecting surface 3A, and since the front of the lower first reflecting surface 3A in the direction of illumination is shaded, light does not reach there. Therefore, when a large light-emitting area is required of the lighting fixture for vehicles 90, it is necessary to make this portion a light-emitting area, as well.

To meet this requirement, the lower first reflecting surface 3A is eliminated and a second light source 11B is provided instead in the tenth embodiment, thus allowing the lower second reflecting surface 4A to radiate light from the second light source 11B in the direction of illumination. Therefore, the upper first reflecting surface 3B needs only to supply light from the first light source 11A to the other second reflecting surface 4B.

Figure 18:
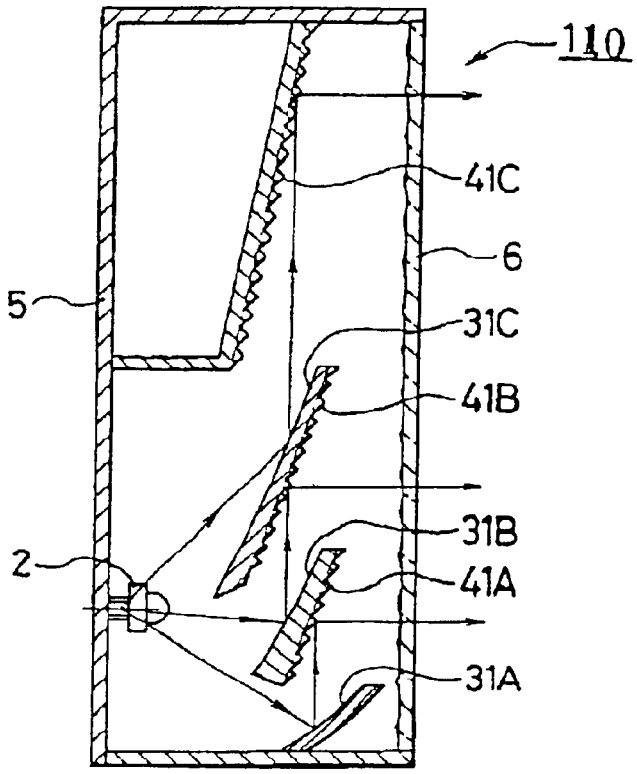
FIG. 18 is a horizontal sectional view of the eleventh embodiment of a lighting fixture for vehicles to which the present invention applies.
Figure 19:
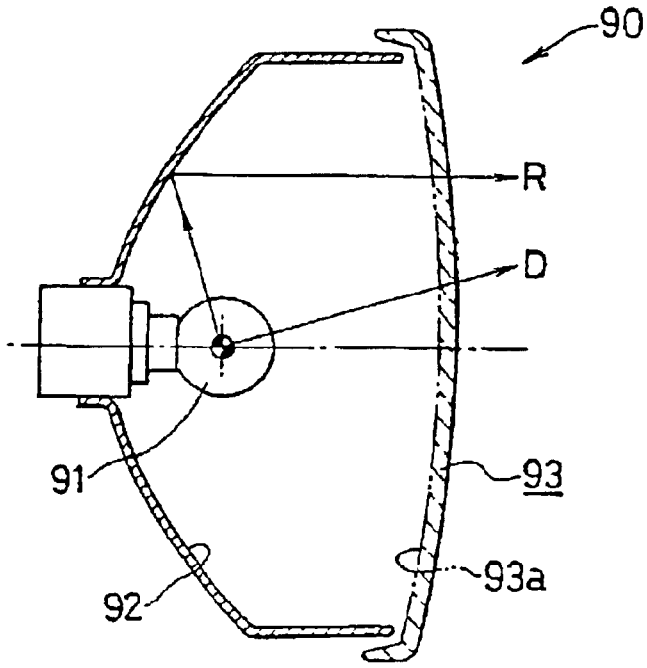
Fig. 19 PRIOR ART
FIG. 19 is a horizontal sectional view of a conventional example.

FIG. 18 shows the eleventh embodiment of a lighting fixture for vehicles of the present invention. Unlike the ninth and tenth embodiments comprising one surface in which the upper first reflecting surface 3B and the lower second reflecting surface 4A are integrated, this embodiment is not limited to such a configuration and comprises an unrestricted number of composite surfaces, each comprised of first reflecting surface 3 and second reflecting surface 4.

That is, three surfaces are provided as first reflecting surfaces in this embodiment, namely, a lower first reflecting surface 31A, intermediate first reflecting surface 31B and upper first reflecting surface 31C, and light from a single light source 11 is distributed among these first reflecting surfaces 31A through 31C so that each of these surfaces generates reflected light or approximately parallel light headed upward in the approximately vertical direction.

Moreover, three second reflecting surfaces are provided as counterparts of the first reflecting surfaces 31A through 31C, namely, a lower second reflecting surface 41A which receives reflected light from the lower first reflecting surface 31A, an intermediate second reflecting surface 41B which receives reflected light from the intermediate first reflecting surface 31B and an upper second reflecting surface 41C which receives reflected light from the upper first reflecting surface 31C.

Further, the lower second reflecting surface 41A, which receives reflected light from the lower first reflecting surface 31A, is integrated into the back of the intermediate first reflecting surface 31B, and additionally the intermediate second reflecting surface 41B, which receives reflected light from the intermediate first reflecting surface 31B, is integrated into the back of the upper first reflecting surface 31C.

Note that an example, in which the three first reflecting surfaces and only one light source 11 are provided, is used in the description of this embodiment, however, this invention is not limited to such an embodiment, and it is possible, for example, to provide a first and second light sources or increase the number of first reflecting surfaces as desired as described in the tenth embodiment.

Moreover, although all the embodiments use LEDs as light sources, this invention is not limited to such a configuration, and light sources may be, for example, smallsize incandescent lamps or linear light sources such as fluorescent tubes including hot cathodes and cool cathodes. Note that if a fluorescent tube is used as a light source, it is possible to employ a curved surface called parabolically cylindrical surface, whose vertical cross section is parabolic and whose horizontal cross section is linear, as desired since this tube emits light horizontally.

As discussed above, according to the present invention, light emitted by respective light sources is reflected by respective first reflecting surfaces to change into parallel light which either is reflected by intermediate reflecting surfaces or falls directly on second reflecting surfaces, and is further reflected by second reflecting surfaces to be radiated forward via lens.

In this case, the majority of light emitted by light sources is reflected by first reflecting surfaces to change into parallel light and used for forward radiation, thus providing improved utilization efficiency. Therefore, fewer light sources are needed to obtain illumination light of the same brightness, thereby reducing cost and possibly reducing produced heat.

Moreover, light sources are provided outside the lens in relation to the direction of the optical axis, which keeps the light sources out of direct sight during illumination when viewed from the front, and which allows only the light-emitting portion reflected by the second reflecting surface to be viewed, thus preventing the light sources from being viewed as luminance spots and giving a feeling of uniform illumination.

Further, when viewed similarly from the front during non-illumination, the light sources remain out of direct sight, thus ensuring improved aesthetical pleasantness during non-illumination, as well.

Thus, according to the present invention, highly excellent lighting fixtures can be provided which are designed to ensure increased light beam utilization efficiency and improved aesthetical pleasantness with minimal unevenness of light on the light-emitting surface.

Moreover, according to the present invention as discussed above, lighting fixtures for vehicles have at least one light source, at least a first reflecting surface which receives light from the light source and allows it to converge into approximately parallel light, at least a second reflecting surface which receives light from the convergent reflecting surface and reflects it in the direction of illumination of the lighting fixtures, and wherein at least one composite reflecting surface, one side of which is the first reflecting surface and another side of which is the second reflecting surface, is provided. Firstly, this allows the first reflecting surface to be covered from the front of the light source, thus keeping the light source out of sight during illumination, providing uniform brightness of the light-emitting surface for improved aesthetical pleasantness and producing highly excellent effect for improving marketability.

Further, such a configuration allows reflecting surfaces to be positioned at a fixed depth in the housing, thus making it possible to make the housing slimmer. This leads to highly excellent effects for improving the practicality of vehicles such as reduced areas of the housing protruding into the trunk room and increased available capacity.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A lighting fixture for vehicles comprising:

at least one light source;

a first reflecting surface;

an intermediate reflecting surface;

a second reflecting surface;

said first reflecting surface comprising a parabolic surface or a parabolic surface in the form of a paraboloid of revolution reflecting light from said at least one light source toward said intermediate reflecting surface and said light source is provided on a focus of said first reflecting surface, said intermediate reflecting surface reflecting light from said first reflecting surface toward said second reflecting surface, said second reflecting surface reflecting light from said intermediate reflecting surface forward; and a lens disposed forwardly of said second reflecting surface;

wherein said at least one light source is disposed outside said lens with respect to a direction of an optical axis;

wherein a pair of said second reflecting surfaces are provided one surface above the other, wherein said light source, said first reflecting surface and/or said intermediate reflecting surface are disposed above the upper one of said pair of second reflecting surfaces, and wherein said light source, said first reflecting surface and/or said intermediate reflecting surface are disposed below said lower one of said pair of second reflecting surfaces.

2. A lighting fixture for vehicles according to claim 1, wherein light emitted from said upper light source is reflected by said upper first reflecting surface and/or said upper intermediate reflecting surface to fall on said upper second reflecting surface, and wherein light emitted by said lower light source is reflected by said lower first reflecting surface and/or said lower intermediate reflecting surface to fall on said lower second reflecting surface.

3. A lighting fixture for vehicles according to claim 1, wherein light emitted by said upper light source is reflected by said upper first reflecting surface and/or said upper intermediate reflecting surface to fall on said lower second reflecting surface, and wherein light emitted by said lower light source is reflected by said lower first reflecting surface and/or said lower intermediate reflecting surface to fall on said upper second reflecting surface.

* * * * *